US010480525B2

(12) United States Patent
Xu et al.

(10) Patent No.: US 10,480,525 B2
(45) Date of Patent: Nov. 19, 2019

(54) FAN BLADE WITH IMPROVED STRUCTURE

(71) Applicant: ASIA VITAL COMPONENTS CO., LTD., New Taipei (TW)

(72) Inventors: Liang-Hua Xu, New Taipei (TW); Te-Chung Wang, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 323 days.

(21) Appl. No.: 15/063,519

(22) Filed: Mar. 8, 2016

(65) Prior Publication Data

US 2017/0260984 A1 Sep. 14, 2017

(51) Int. Cl.
*F04D 29/30* (2006.01)

(52) U.S. Cl.
CPC ..... *F04D 29/30* (2013.01)

(58) Field of Classification Search
CPC .... F04D 29/281; F04D 29/624; F04D 29/388; F04D 29/34; F04D 25/08; F04D 19/002
See application file for complete search history.

(56) References Cited

U.S. PATENT DOCUMENTS 1,975,911 A * 10/1934 Rijswijk ..... F04D 29/34 416/219 A
2,483,610 A * 10/1949 Baumann ..... F01D 5/3007 29/889.4
3,446,429 A * 5/1969 Tadayuki ..... F04D 29/646 416/220 A
4,060,338 A * 11/1977 Macauley ..... F04D 29/34 416/208
4,173,429 A * 11/1979 Hoffman ..... F01D 5/025 416/184
4,205,510 A * 6/1980 Raniero ..... A01D 34/82 56/12.9
4,662,830 A * 5/1987 Pottebaum ..... H05K 7/20172 361/695
4,715,784 A * 12/1987 Mosiewicz ..... F01D 5/3069 29/557
5,487,639 A * 1/1996 Asabuki ..... F04D 23/008 415/55.1
6,139,277 A * 10/2000 Lopatinsky ..... F01D 5/3015 416/220 A (Continued)

FOREIGN PATENT DOCUMENTS

CN 1643261 A 7/2005
CN 1877133 A 12/2006

(Continued)

*Primary Examiner* — Justin D Seabe
*Assistant Examiner* — Adam W Brown
(74) *Attorney, Agent, or Firm* — C. G. Mersereau; DeWitt LLP

(57) ABSTRACT

A fan blade with improved structure includes a hub, a plurality of blades. The hub has a lateral side having two ends, one of which is formed a top side and the other end is extended to form an extended section, and a plurality of connecting slots located on the periphery of the extended section. Each blade has a first end correspondingly engaged in respective connecting slot and a second end. With these arrangements, the fan blade with improved structure can increase structural strength of thin fan blades and be easy to connect the hub to the blades.

6 Claims, 10 Drawing Sheets

(56) References Cited

U.S. PATENT DOCUMENTS 6,619,923 B2 * 9/2003 Chien ..... F04D 29/2222 416/183
7,097,430 B2 * 8/2006 Harris ..... B29C 45/14065 264/45.3
7,399,161 B2 * 7/2008 Kao ..... F04D 29/30 416/187
8,092,181 B2 * 1/2012 Nishino ..... F04D 17/04 29/889.4
8,128,372 B2 * 3/2012 Best ..... F04D 29/34 416/207
8,333,438 B2 * 12/2012 Caule ..... B64C 25/36 188/264 AA
8,727,729 B2 * 5/2014 Noronha ..... B23P 15/006 416/186 R
8,807,939 B2 * 8/2014 Gardas ..... F04D 29/646 416/147
9,267,507 B2 * 2/2016 Wu ..... F04D 25/0613
9,523,372 B2 * 12/2016 Stagg ..... B29C 45/14336
9,664,194 B2 * 5/2017 Oleson ..... F04D 25/088
2009/0297344 A1 * 12/2009 Hill ..... F01D 5/048 415/208.1
2013/0243628 A1 * 9/2013 Zheng ..... F04D 17/04 417/423.7
2015/0013945 A1 * 1/2015 Choi ..... F24F 1/0007 165/121
2015/0233389 A1 * 8/2015 Moll ..... F04D 29/662 416/145
2015/0360292 A1 * 12/2015 Kountanya ..... B22F 5/04 419/53

FOREIGN PATENT DOCUMENTS

CN 102954035 A 3/2013
CN 203175946 U 9/2013
CN 104196758 A 12/2014
CN 103104510 B 2/2016
JP 20110047388 A 3/2011
TW M350746 2/2009
TW 201341167 A 10/2013
TW M502749 U 6/2015

* cited by examiner

FAN BLADE WITH IMPROVED STRUCTURE

FIELD OF THE INVENTION

The present invention relates to a fan blade with improved structure, and more specifically, to a fan blade with improved structure that can enhance structural strength of thin fan blades of a fan.

BACKGROUND OF THE INVENTION

A fan made of metal or plastic is widely used to remove heat produced by electronic elements. When the blades of the fan are made of plastic by injection technology processing, each blade must have a certain thickness, normally thicker than 0.3 mm, since the fan is unlikely to add the number of blades to thereon, or it could break due to high instant stress of wind resistance when operating. Therefore, the inventor tries to develop a fan blade with improved structure to overcome the foregoing drawbacks in the prior art fan.

SUMMARY OF THE INVENTION

A primary object of the present invention is to provide a fan blade with improved structure that can increase structural strength of thin fan blades of a fan.

Another object of the present invention is to provide a fan blade with improved structure that can provide a better and easy way to connect the hub to the blades and is able to prevent a fan from imbalanced due to uneven distribution of weight problem in the art fan.

To achieve the above and other objects, the fan blade with improved structure provided according to the present invention includes a hub, a plurality of blades. The hub has a lateral side having two ends, one of which is formed a top side and the other end is extended to form an extended section, and a plurality of connecting slots located on the periphery of the extended section. Each blade has a first end correspondingly engaged in respective connecting slot and a second end.

With the first end of each blade correspondingly engaged in respective connecting slot located on the periphery of the extended section of the hub, and the blades are correspondingly engaged and fitted in the connecting slots of the hub by laser welding or mechanical processing, the fan blade with improved structure can increase structural strength of thin fan blades of a fan without the risk of imbalance of the fan blades due to uneven distribution of weight problem in the art fan.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
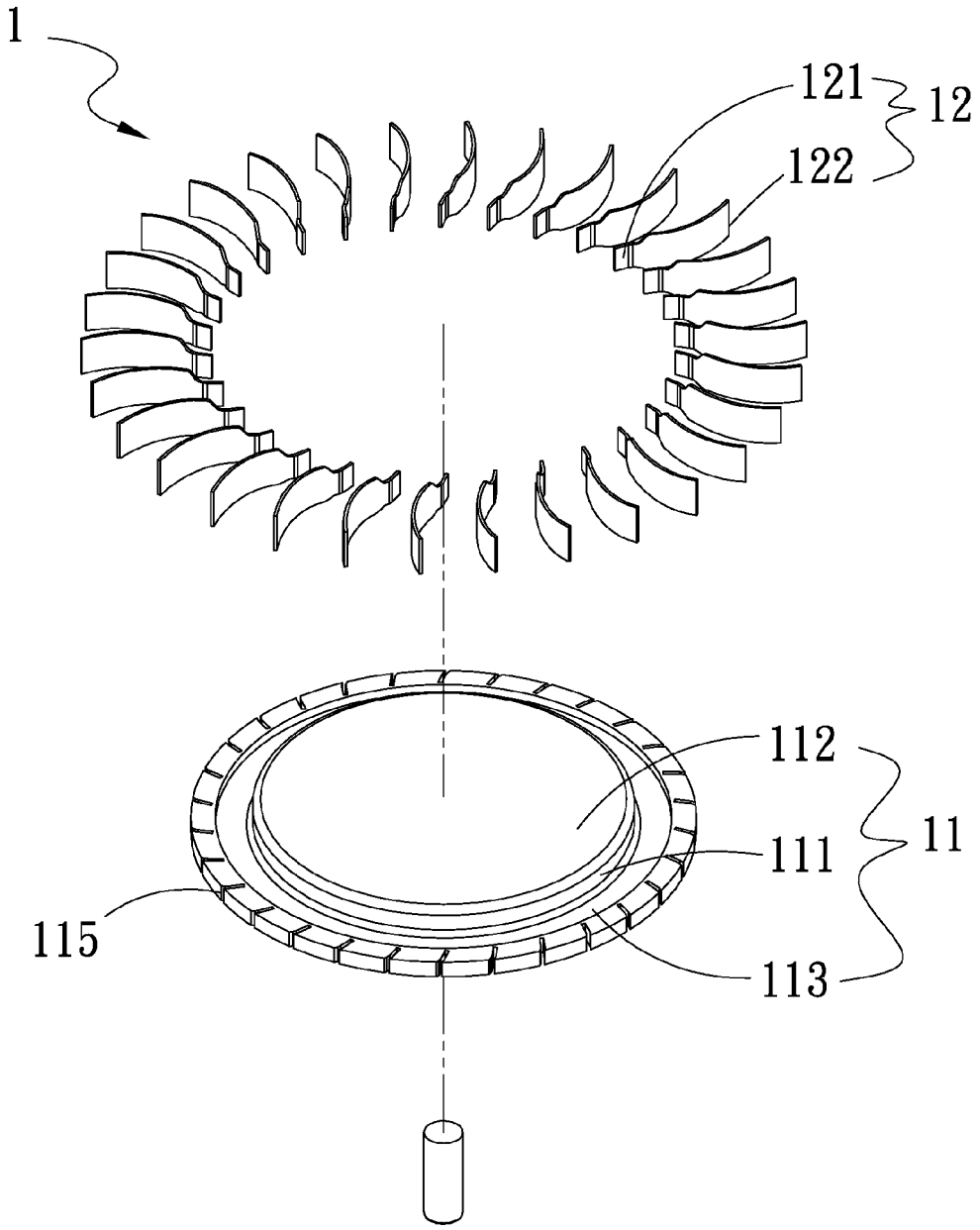
FIG. 1 is an exploded perspective view of a fan blade with improved structure of the present invention according to a first embodiment thereof.

The present invention will now be described with some preferred embodiments thereof and by referring to the accompanying drawings. For the purpose of easy to understand, elements that are the same in the preferred embodiments are denoted by the same reference numerals.

Figure 2:
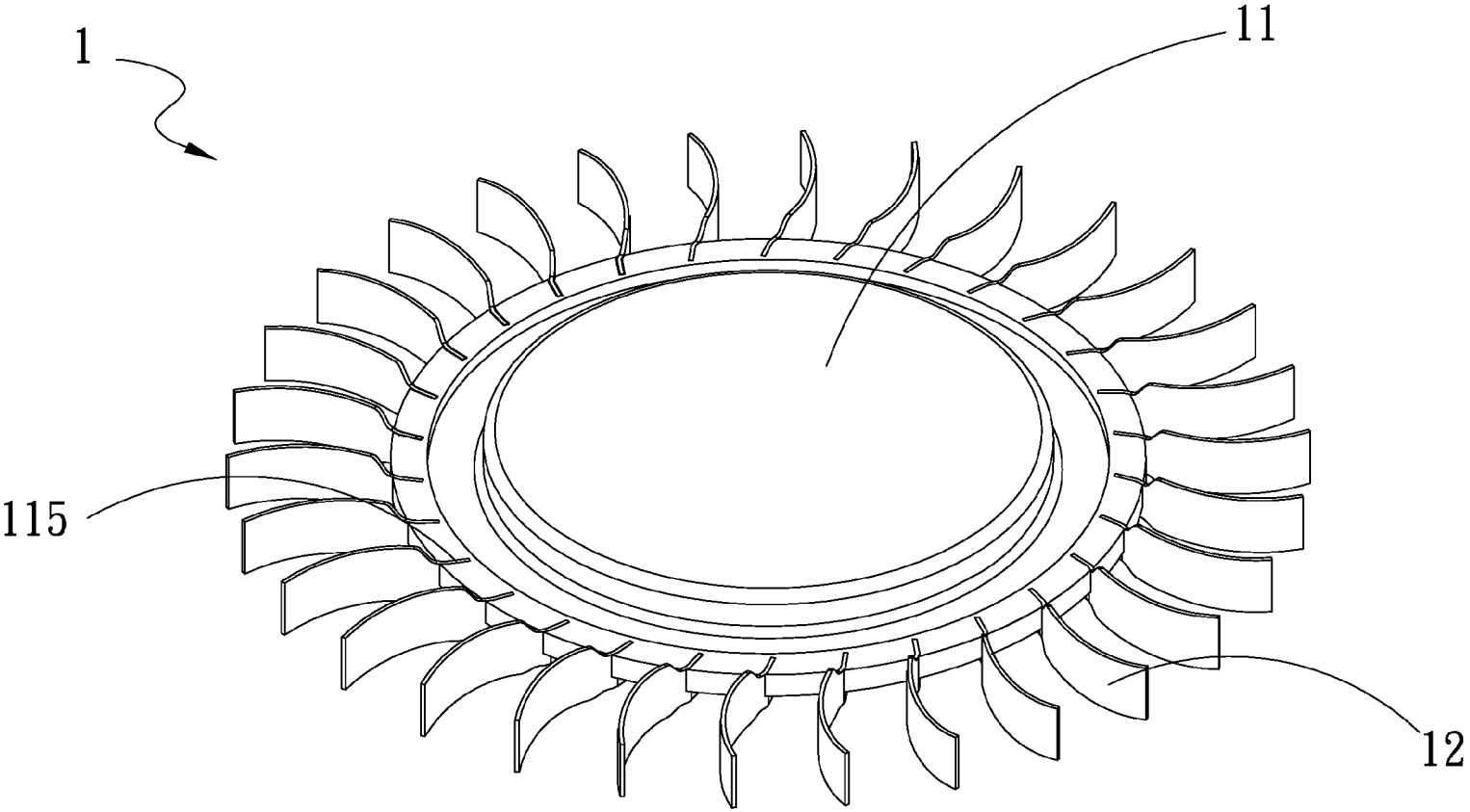
FIG. 2 is an assembled perspective view of FIG. 1.
Figure 3A:
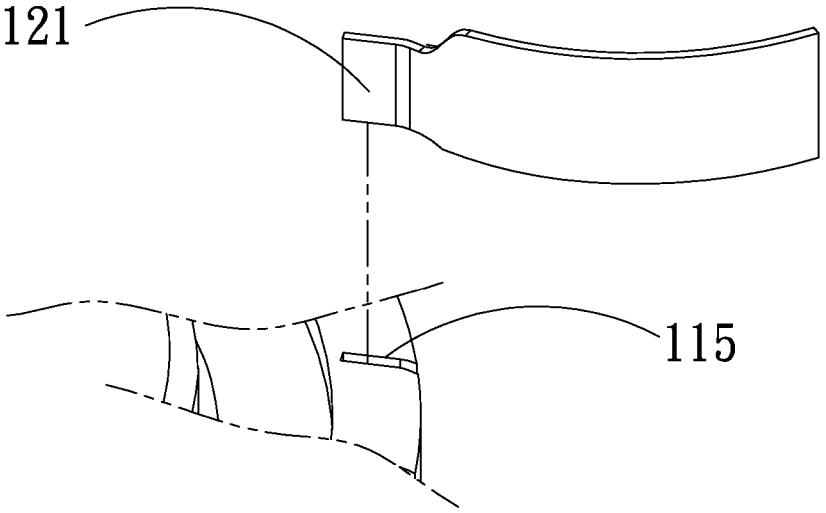
FIGS. 3A and 3B show the fan blade with improved structure before and after a first end of a blade is engaged in respective connecting slot included therein of the present invention according to the first embodiment thereof.
Figure 3B:
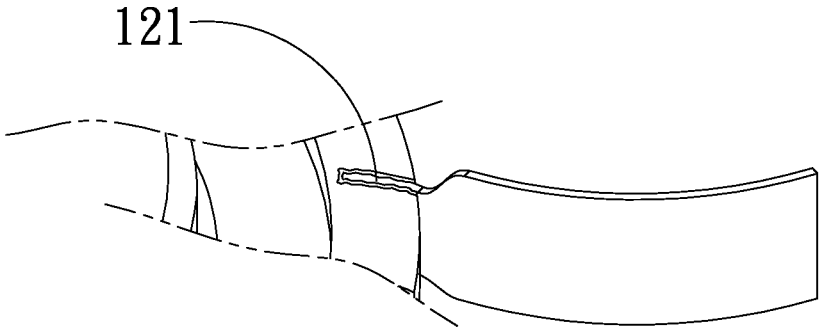
Figure 4:
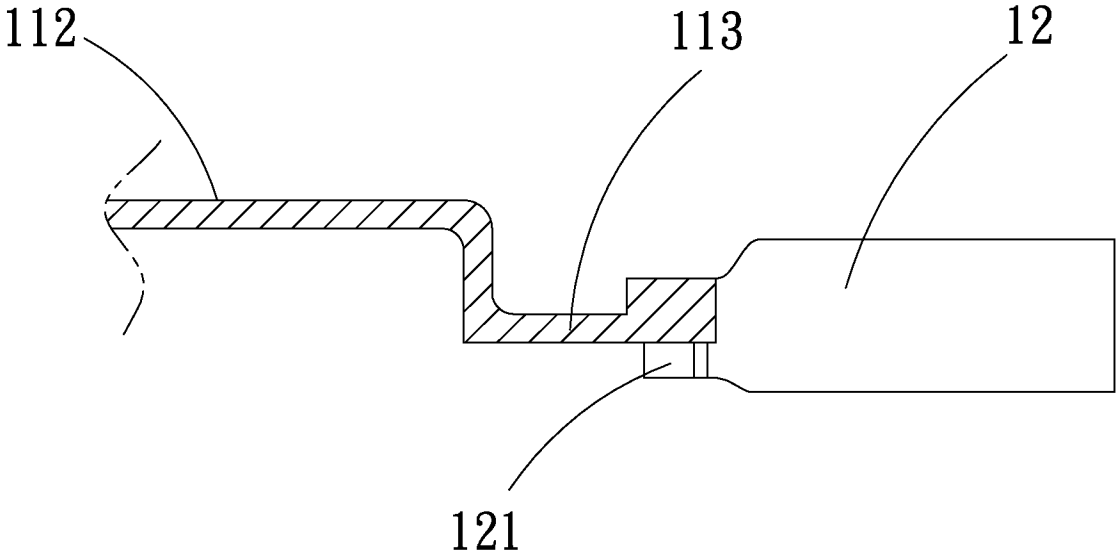
FIG. 4 is a fragmentary sectional view of the present invention according to the first embodiment thereof.

Please refer to FIGS. 1, 2, which are exploded and assembled perspective views, respectively, of a fan blade with improved structure according to a first embodiment of the present invention, to FIGS. 3A and 3B show the fan blade with improved structure before and after a first end of a blade is engaged in respective connecting slot included therein according to a first embodiment of the present invention, and FIG. 4 is a fragmentary sectional view according to the first embodiment of the present invention. As shown, a fan blade with improved structure 1 includes a hub 11, a plurality of blades 12. The hub 11 has a lateral side 111 having two ends, one of which is formed a top side 112 and the other end is extended to form an extended section 113, and a plurality of connecting slots 115 are located on the periphery of the extended section 113. Also, the lateral side 111, the top side 112, and the extended section 113 of the hub 11 are integrally molded.

In the illustrated first embodiment, the connecting slots 115 are equally spaced on the periphery of the extended section 113. However, in practically implementation, the connecting slots 115 can be non-equally spaced on the periphery of the extended section 113 (not shown).

Each blade 12 has a first end 121 and an opposite second end 122, wherein the first end 121 is a connecting end, whereas the second end 122 is a free end. The first end 121 is correspondingly engaged in respective connecting slot 115. In the illustrated first embodiment, each blade 12 can be, but not limited to, curved-shaped. However, in practically implementation, each blade 12 can be curved-shaped or non-curved-shaped.

The first end 121 of each blade 12 has a height smaller than or equal to that of the second end 122 of each blade 12. In the illustrated first embodiment, the height of the first end 121 can be, but not limited to, smaller than that of the second end 121.

The blades 12 in the illustrated first embodiment are made of metal by metal stamping or injection technology processing and preferably, each blade 12 has a thickness smaller than 0.15 mm. The hub 11 is also made of metal by die-casting or metal stamping. The blades 12 are correspondingly engaged in the connecting slots 115 of the hub 11 by laser welding. In the illustrated first embodiment, since the blades 12 and the hub 11 are made of metal, they are fusion to join together by laser welding at the junction between the blades 12 and the hub 11, such that the blades 12 can be fixedly connected to the hub 11 without additional solder or filler to have enhanced structural strength of blades 12 and to prevent a fan from imbalanced due to uneven distribution of weight problem in the art fan With these arrangements, the first ends 121 of the blades 12 are respectively correspondingly engaged in respective connecting slots 115 on the periphery of the extended section 113, then the first ends 121 of the blades 12 are fixedly fitted in the connecting slots 115 by laser welding, such that the blades 12 are fixedly connected to the hub 11, so as to largely enhance structural strength of blades 12 and prevent the fan from imbalanced due to uneven distribution of weight problem caused by connecting the blades to the hub with solder or filler in the art fan.

Figure 5:
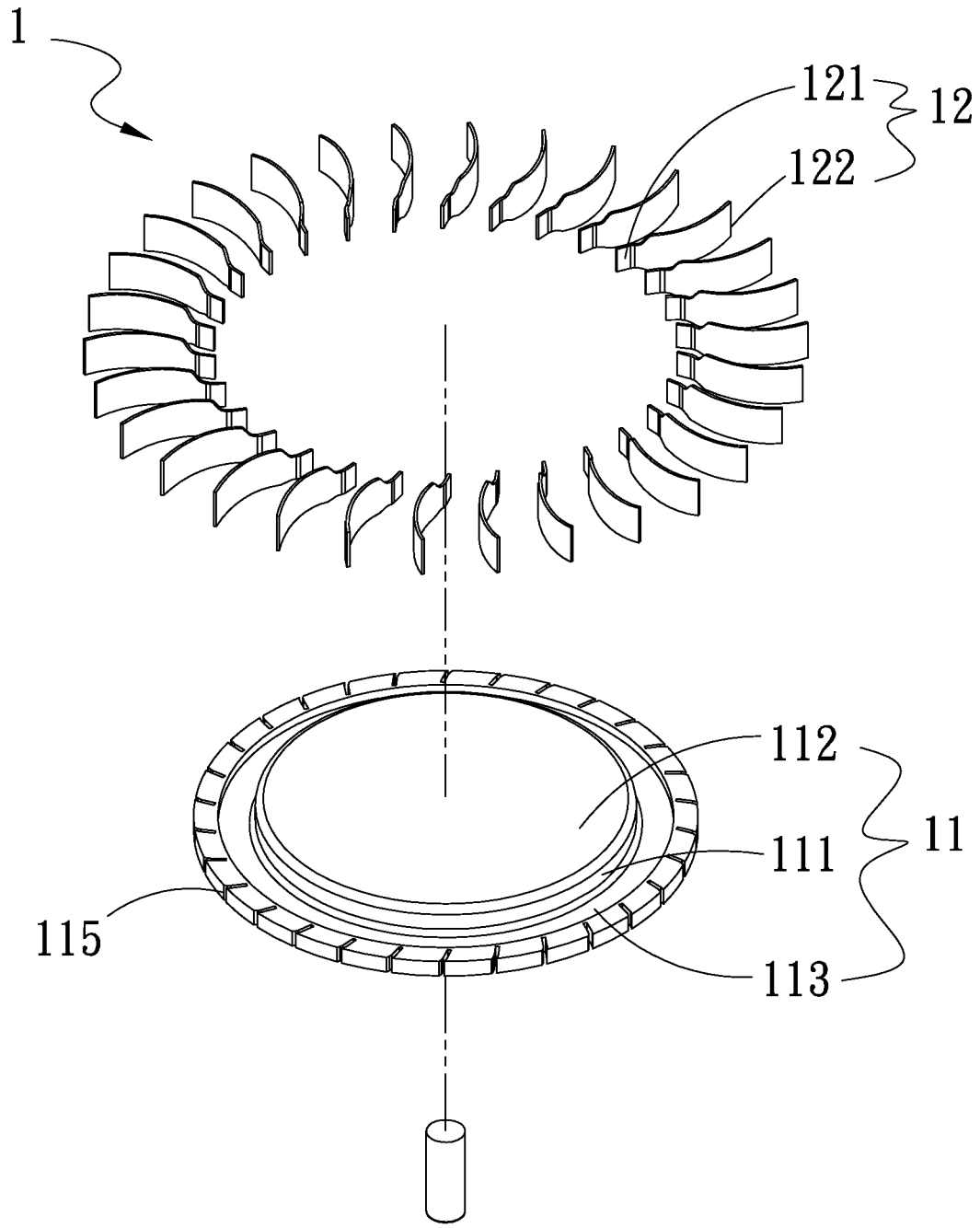
FIG. 5 is an exploded perspective view of the fan blade with improved structure of the present invention according to a second embodiment thereof.
Figure 6A:
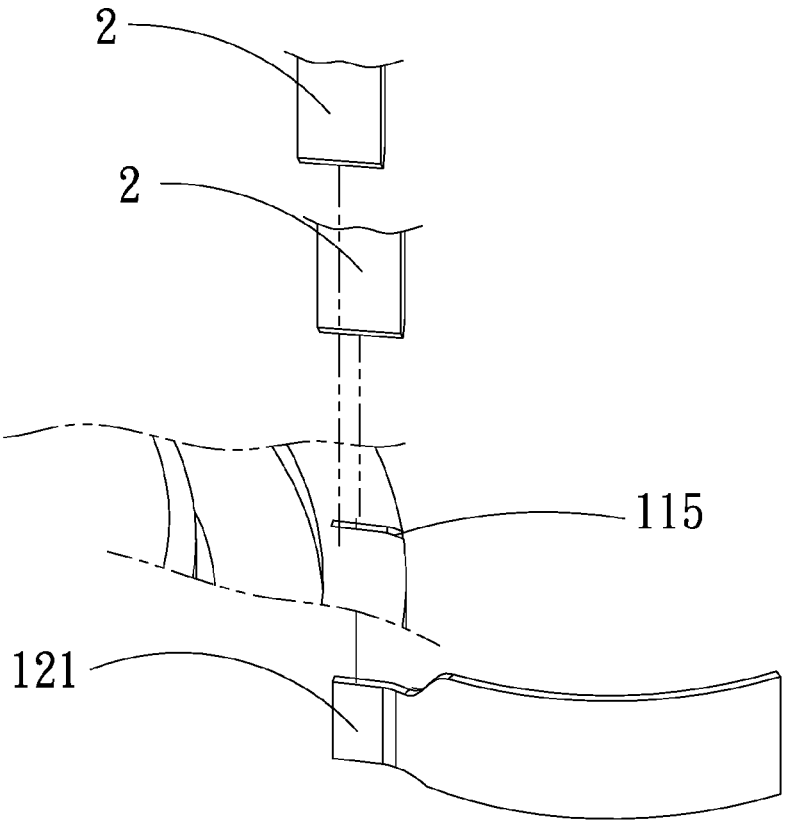
FIGS. 6A and 6B show the fan blade with improved structure before and after a first end of a blade is engaged in respective connecting slot included therein and two sides next to each connecting slot on a extended section before and after downwardly are formed two recesses by two jigs to fit the first end of each blade in respective connecting slot included in the present invention according to the second embodiment thereof.
Figure 6B:
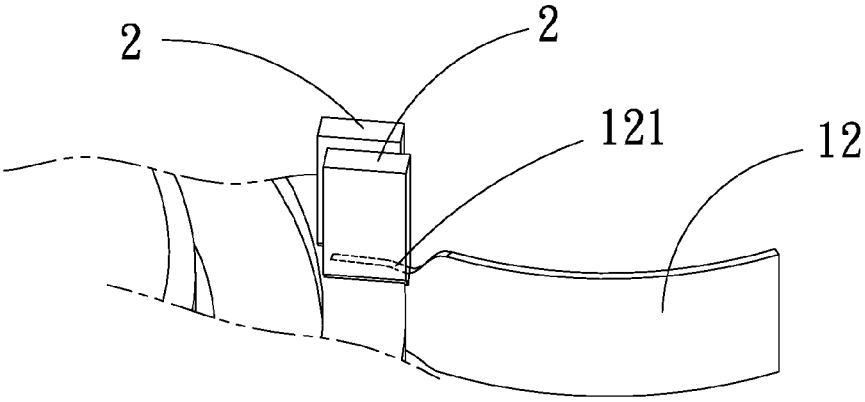
Figure 6C:
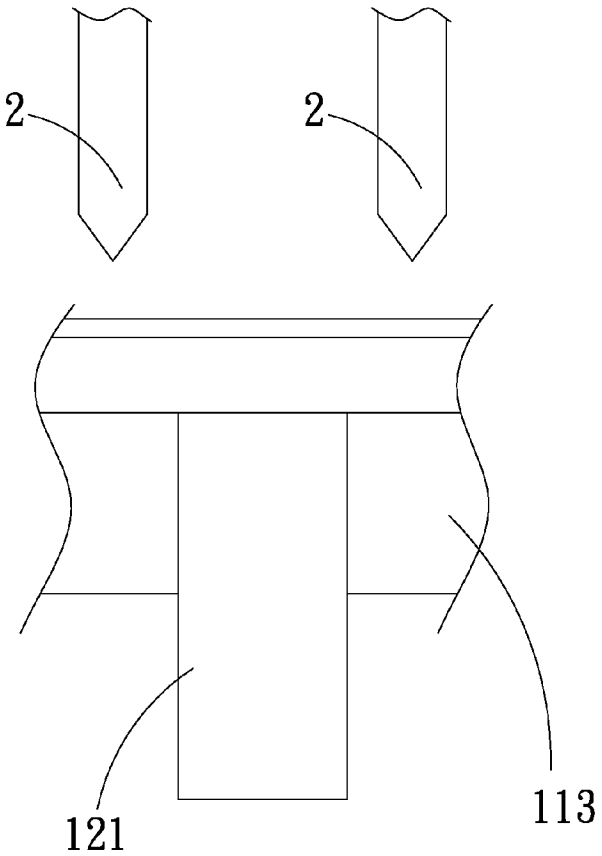
FIGS. 6C and 6D are enlarged views of FIGS. 6A and 6B.
Figure 6D:
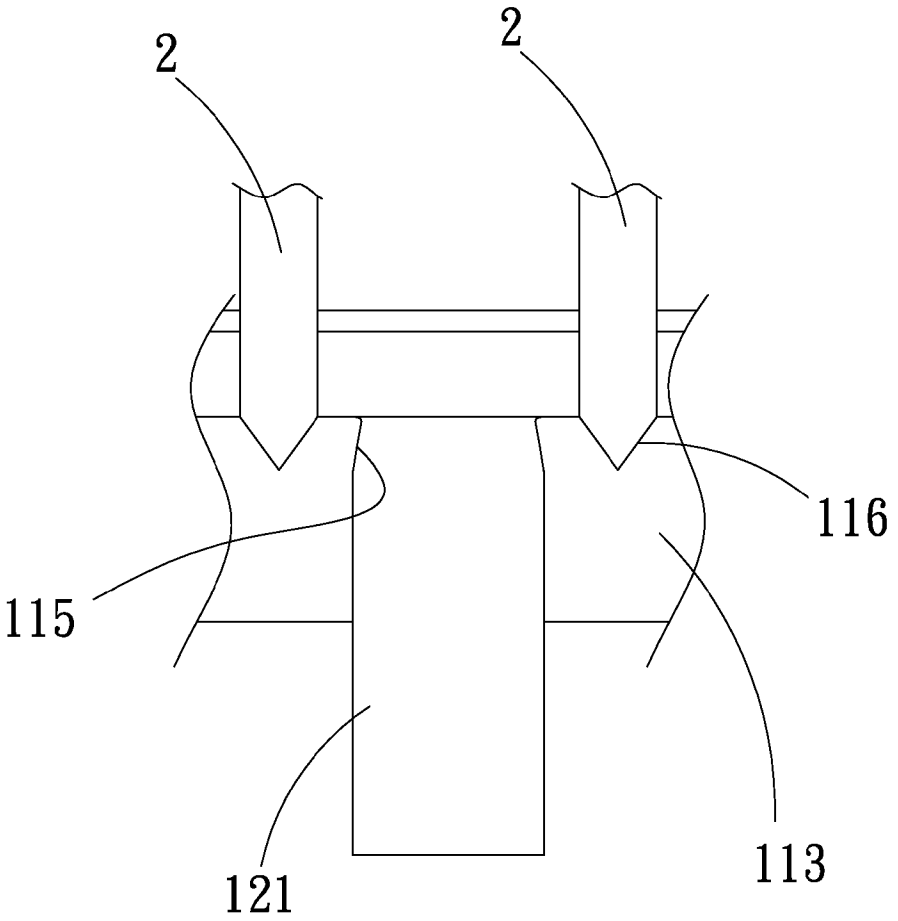

Please refer to FIG. 5, which is an exploded perspective view of the fan blade with improved structure according to a second embodiment of the present invention, to FIGS. 6A and 6B, which show the fan blade with improved structure before and after a first end of a blade is engaged in respective connecting slot included therein and two sides next to each connecting slot on a extended section before and after downwardly are formed two recesses by two jigs to fit the first end of each blade in respective connecting slot according to the second embodiment of the present invention, and FIGS. 6C and D, which are enlarged views of FIGS. 6A and 6B. In another possible embodiment, after the first ends 121 of the blades 12 are fitted in the connecting slots 115, respectively, two jigs 2 are downwardly or/and upwardly pressed onto the extended section 113 at two lateral opposite sides of each connecting slot 115 to insert into the extended section 113, such that two recesses 116 are formed and two opposite internal wall surfaces of the connecting slot 115 are internally squeezed to have the first end 121 of each blade 12 fitted in respective connecting slot 115 on the extended section 113, so as to fixedly connect the blades 12 to the hub 11.

Figure 7:
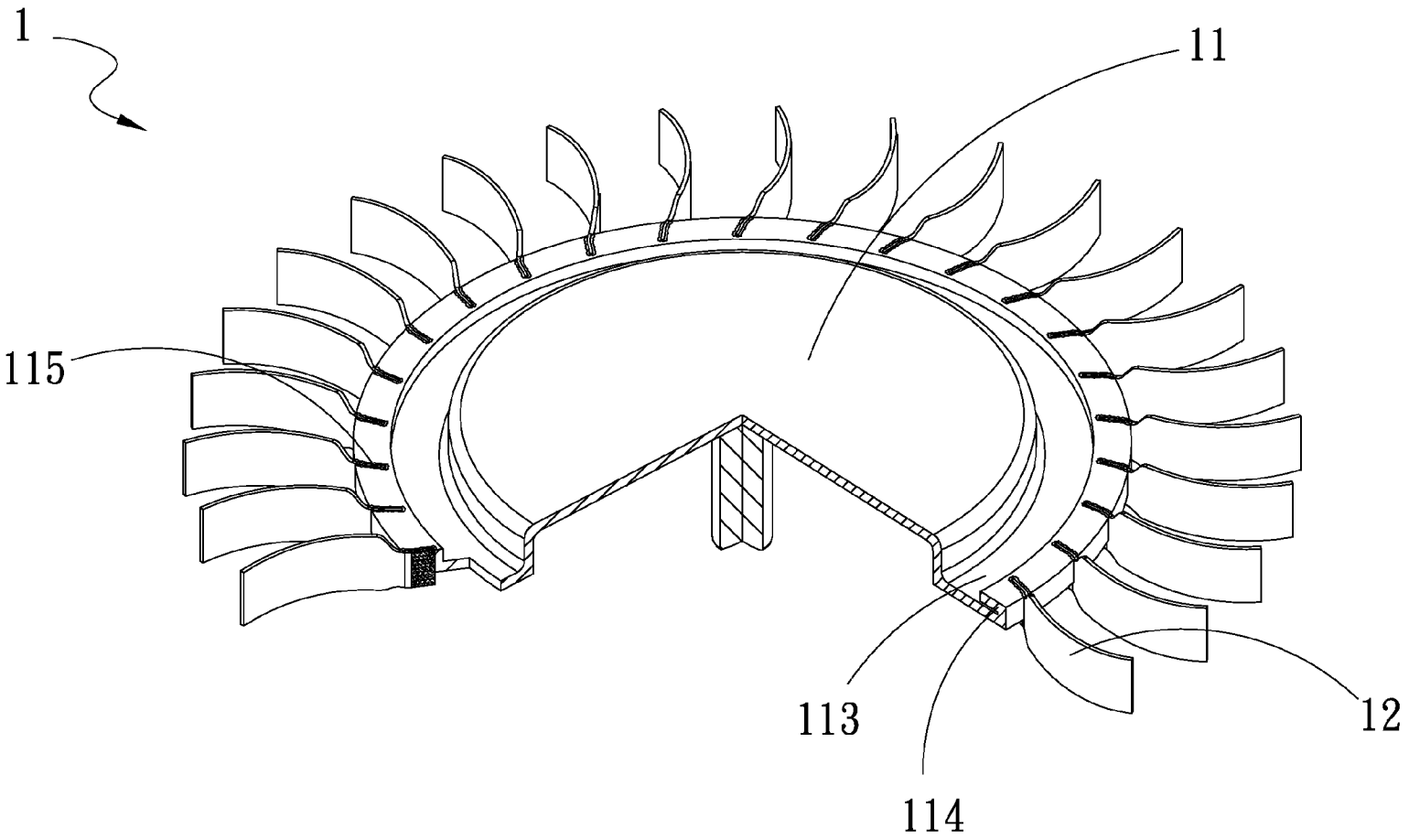
FIG. 7 shows a sectional perspective view of the fan blade with improved structure of the present invention according to a third embodiment thereof.
Figure 8:
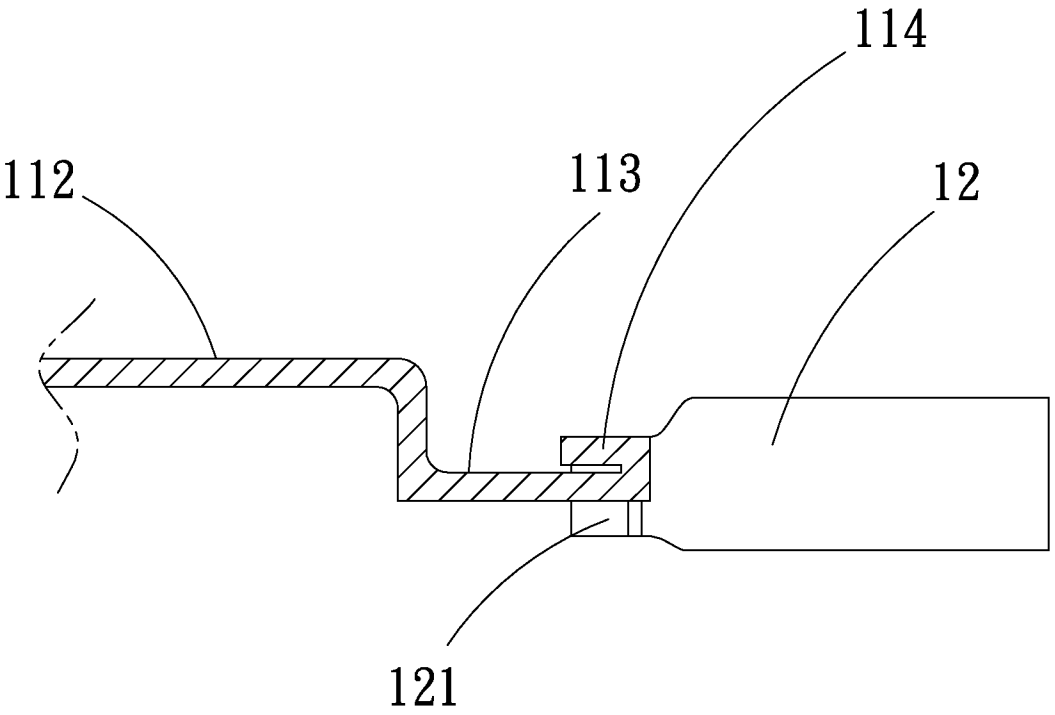
FIG. 8 is a fragmentary sectional view of the present invention according to the third embodiment thereof.

Please refer to FIG. 7, which shows a sectional perspective view of the fan blade with improved structure according to a third embodiment of the present invention, and FIG. 8, which is a fragmentary sectional view according to the third embodiment of the present invention.

The third embodiment of the fan blade with improved structure 1 is generally structurally similar to the first embodiment except that, in this third embodiment, the extended section 113 of the hub 11 is upwardly extended from the periphery thereof toward the top side 113 of the hub 11 to form a connecting portion 114, so is the connecting slots 114 extended to the connecting portion 114. With the third embodiment, the first ends 121 of the blades 12 are fitted in the connecting slots 115 by laser welding, providing the same effects as mentioned above.

In conclusion, compared to the prior art fan with the fan blade with improved structure of the present invention has many advantages as follows: (1) having enhanced structural strength of thin fan blades; and (2) providing a more effective way to connect the hub to the blades which can prevent a fan from imbalanced due to uneven distribution of weight problem in the art fan.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan blade with improved structure, comprising:

a hub including a lateral side having two ends, one of which being formed a top side and the other end being extended to form an extended section, and plurality of connecting slots being located on the periphery of the extended section, the extended section is upwardly extended to form a connecting portion on a periphery of the hub and extending upwardly toward the top of the hub and containing the connecting slots giving the connecting portion a U-shape from a side view; and a plurality of blades, each of which having a first and an opposite second end; and the first end correspondingly being engaged in respective connecting slot and forming a weld part by laser welding at the junction between the blades and the hub, wherein the first end of each blade and the hub have a height smaller than the second end of each blade.

2. The fan blade with improved structure as claimed in claim 1, wherein the connecting slots are equally or non-equally spaced on the connecting portion.

3. The fan blade with improved structure as claimed in claim 1, wherein each blade is curved-shaped or non-curved-shaped.

4. The fan blade with improved structure as claimed in claim 1, wherein both the hub and the blades are made of the same or different materials.

5. The fan blade with improved structure as claimed in claim 1, wherein each blade has a thickness smaller than 0.15 mm.

6. The fan blade with improved structure as claimed in claim 1, wherein the lateral side, the top side, and the extended section of the hub are integrally molded.

* * * * *